US009068752B2

(12) United States Patent
Shaffer et al.

(10) Patent No.: US 9,068,752 B2
(45) Date of Patent: Jun. 30, 2015

(54) RAPID GAS IGNITION SYSTEM

(75) Inventors: Timothy Scott Shaffer, Louisville, KY (US); Nicholas Okruch, Jr., Louisville, KY (US); Daniel Trice, Louisville, KY (US); Brian Schork, Louisville, KY (US); Mark Johnson, Louisville, KY (US); Daniel Ernst, Louisville, KY (US); Daniel Brosnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1388 days.

(21) Appl. No.: 12/709,673

(22) Filed: Feb. 22, 2010

(65) Prior Publication Data

US 2011/0207065 A1 Aug. 25, 2011

(51) Int. Cl.
*F23Q 7/22* (2006.01)
*F24C 3/10* (2006.01)

(52) U.S. Cl.
CPC ..... *F24C 3/103* (2013.01)

(58) Field of Classification Search
USPC ..... 431/73, 45; 126/25 B, 39 BA, 39 E
See application file for complete search history.

(56) References Cited

U.S. PATENT DOCUMENTS

| | | | | | |
|---|---|---|---|---|---|
| 3,705,783 | A | * | 12/1972 | Warren | 431/46 |
| 4,600,827 | A | * | 7/1986 | Linwood et al. | 219/492 |
| 4,669,430 | A | | 6/1987 | Reinold et al. | |
| 4,858,576 | A | | 8/1989 | Jeffries et al. | |
| 4,925,385 | A | | 5/1990 | McCord, Jr. | |
| 4,925,386 | A | | 5/1990 | Donnelly et al. | |
| 4,935,606 | A | | 6/1990 | Geary | |
| 5,329,918 | A | * | 7/1994 | Di Bari | 126/39 BA |
| 5,416,300 | A | | 5/1995 | Hickl et al. | |
| 5,725,368 | A | * | 3/1998 | Arensmeier | 431/66 |
| 5,769,622 | A | * | 6/1998 | Aoki et al. | 431/80 |
| 5,865,612 | A | | 2/1999 | Hill et al. | |
| 5,951,276 | A | * | 9/1999 | Jaeschke et al. | 431/66 |
| 6,104,008 | A | | 8/2000 | Larson | |
| 6,217,312 | B1 | * | 4/2001 | Levinson et al. | 431/6 |
| 6,474,979 | B1 | | 11/2002 | Rippelmeyer | |
| 6,521,869 | B1 | * | 2/2003 | Donnelly et al. | 219/263 |
| 6,966,315 | B2 | * | 11/2005 | Pickering | 126/39 E |
| 7,148,454 | B2 | * | 12/2006 | Chodacki et al. | 219/497 |
| 7,671,305 | B2 | * | 3/2010 | Chodacki et al. | 219/497 |
| 7,798,139 | B2 | * | 9/2010 | Gagas et al. | 126/25 R |
| 2003/0164368 | A1 | * | 9/2003 | Chodacki et al. | 219/497 |
| 2007/0007278 | A1 | * | 1/2007 | Chodacki et al. | 219/497 |
| 2007/0128563 | A1 | * | 6/2007 | Subramanian et al. | 431/278 |
| 2010/0108658 | A1 | * | 5/2010 | Chodacki et al. | 219/262 |
| 2011/0086319 | A1 | * | 4/2011 | Chodacki et al. | 431/74 |

* cited by examiner

*Primary Examiner* — Avinash Savani
(74) *Attorney, Agent, or Firm* — Global Patent Operation; Douglas D. Zhang

(57) ABSTRACT

An ignition control system for an appliance is disclosed. The appliance includes a gas burner, a user actuable valve for controlling a flow of fuel to the burner and an electrical resistance igniter for igniting fuel at the burner. The system includes a user actuable control interface having an off state and an on state, coupled to the valve operative to control the valve and provide a control signal indicative of the state of the control interface. The system also includes a controller having a timer circuit responsive to the control signal and a boost circuit coupled to the timer circuit. The timer circuit selectively activates the boost circuit for a predetermined period of time. A first DC power supply is selectively coupled to the igniter to provide power to the igniter through the boost circuit. A second DC power supply is coupled to the igniter and control interface.

20 Claims, 7 Drawing Sheets

RAPID GAS IGNITION SYSTEM

BACKGROUND OF THE INVENTION

The present disclosure relates generally to ignition systems for gas burners and more particularly to ignition systems having electrical resistive hot surface igniters.

Currently, gas cooktops consist of two to eight individual gas burners mounted atop a metallic or ceramic glass cooktop surface. Generally, the burners will consist of a cap and a main burner body, where exhaust gas ports are placed around its periphery. Gas is supplied through user actuable valves that individually control flow to a respective burner. The gas is then directed through gas tubing to an orifice where the gas flow is exhausted at flow rates sufficient to entrain enough air into the gas flow stream to permit combustion at the exhaust ports of the burners. The gas at each burner is ignited at some point near one or several of the exhaust ports. According to United States regulatory requirements, ignition devices for the gas burners must successfully ignite the gas within four (4) seconds of turning the valve to a corresponding ignition point. Generally, cooktop appliances or gas range appliances in the United States and throughout the world either use a spark igniter or a standing pilot system to ignite the gas/air combination exhausted out of the exhaust ports. The standing pilot is a low flow, continuous flame that stays lit even when the system is not in use.

Spark igniters generally only function when a control of a gas cooking appliance is set to a certain position, i.e. at the ignition setpoint on the gas valve knob. Spark igniter systems generally energize all igniters regardless of the specific gas knob being activated. A variation of a spark igniter system that is commonly used on higher end products consists of spark igniter system with a flame sense technology that permits the spark igniter to fire at any non-off control knob position if flame is not sensed. There are several flame sense technologies in practice including those that use temperature sensing devices and those that detect ground to igniter voltage changes when the flame is no longer present. Both of these flame sense technologies are hampered by occasional reliability issues where a false loss of flame is sensed and the igniters fire off sparks when not necessary. Because of the unnecessary activation of the spark igniters, when for example, a burner flame is falsely determined to be lost or out, and because the burner flame sensing is hidden to the consumer, there is often a mistrust of the technology and a perception of not being trustworthy in properly evaluating loss of flame.

In some gas oven applications, hot surface, electrical resistive igniters have replaced pilot lights and spark igniters. Because of their fairly large thermal mass, typical hot surface igniters are relatively slow to reach ignition temperatures and thus require a delay between the user turning on the oven and the opening of the gas control valve feeding fuel to the gas burners inside the oven. It is fairly common for ovens to require a delay on the order of thirty (30) to sixty (60) seconds to allow the surface igniter to heat up to an auto-ignition temperature (e.g. about 700 degrees centigrade for natural gas). While this approach is acceptable to the consumer oven applications, such an extended delay would create a perception to the same consumer of unsafe operation for a cooktop application. Recent advances in low mass, highly conductive ceramic, hot surface igniters using such base materials as silicon nitride, silicon carbide, and other comparable inorganic compounds have led to the development of hot surface igniters that can reach ignition temperatures well within the four (4) second threshold, while still meeting reasonable expectations for a long service life, more attainable. However, the development of a fast responding system using hot surface igniters for appliance applications has been hindered by complexity, lack of reliability, and/or high cost. Typically, microcomputers have been used to control the heating of the hot surface igniter. In one example, an ignition system for a gas burner uses a control algorithm based on an alternating current (AC) modulated signal where a second voltage is applied to the hot surface igniter for maintaining a temperature lower than the fuel ignition temperature. Here the steady state voltage with the igniter below the fuel ignition temperature is intended to permit a longer igniter life cycle. These igniters that are maintained at a steady state below the fuel ignition temperature are generally a silicon nitride igniter with a tungsten filament that is prone to aging.

In another example the microcomputer controls the igniter so that the igniter is rapidly heated via control of the AC power supply to attain ignition temperature and then subsequently reduced from the initial power levels to maintain ignition temperature based on a learning routine. In other examples, the level of AC power to the igniter is based on the determined value of AC voltage available to energize the igniter and on the determined value of the igniter resistance. In still other examples, power is modulated to the igniter by trimming alternating current cycles using, for example, triacs. The main disadvantages of such microcomputer based approaches include a fairly high level of complexity and cost, the potential of software based decisions acting inappropriately for a safety critical system, and, in the case of the AC modulated solutions, a risk of failing due to excessive amounts of power being fed into the igniter. In many applications, there is a requirement that flame sensing technology must be employed concurrently with the hot surface technology to enable a sufficiently long use life. This approach, however, is contrary to research that shows many consumers would prefer to see a continuously glowing igniter as it is perceived to be a more reliable ignition source and to make it easy to detect that igniter is not working properly.

It would be advantageous to control a low voltage DC powered electrical resistive igniter without a microprocessor so that a flame is ignited within a predetermined time period where the igniter is reliable throughout a projected life of a cooktop on which it is installed.

BRIEF DESCRIPTION OF THE INVENTION

As described herein, the exemplary embodiments overcome one or more of the above or other disadvantages known in the art.

One aspect of the exemplary embodiments relates to an ignition control system for an appliance including a gas burner, a user actuable valve for controlling a flow of fuel to the burner and an electrical resistance igniter for igniting fuel at the burner. The control system includes a user actuable control interface having an off state and an on state, coupled to the valve operative to control the valve and provide a control signal indicative of the state of the control interface. The control system also includes a controller having a timer circuit responsive to the control signal and a boost circuit coupled to the timer circuit. The timer circuit is configured to activate the boost circuit for a predetermined period of time. A first direct current power supply is selectively coupled to the electrical resistance igniter by the boost circuit, such that power from the first power supply is provided to the electrical resistance igniter through the boost circuit when the boost circuit is activated. A second direct current power supply is coupled to the electrical resistance igniter and control interface. The second power supply is configured to provide power to the electrical resistance igniter after expiration of the predetermined time period to maintain the igniter at a predetermined temperature above an ignition temperature of the fuel as long as the valve remains on. The voltage from the first direct current power supply is greater than a voltage from the second direct current power supply.

Another aspect of the exemplary embodiments relates to a method for controlling energizing of an electrical resistance igniter in a control system for an appliance having a burner. The method includes receiving a signal in a timer circuit from a respective control interface of the appliance when the respective control interface is in an on position. Power is provided from a first direct current power supply to the electrical resistance igniter through activation of a respective boost circuit, where the timer activates the respective boost circuit for a predetermined period of time. After expiration of the predetermined period of time, the respective boost circuit is deactivated and the power provided to the electrical resistance igniter is switched from the first direct current power supply to a second direct current power supply to maintain the igniter at a predetermined temperature above an ignition temperature of the fuel, where a voltage provided by the second direct current power supply is less than a voltage supplied by the first direct current power supply.

Still another aspect of the disclosed embodiments relates to an ignition control system for a gas cooking appliance. The appliance includes a burner, a user actuable valve for controlling a flow of fuel to the burner and movable between an off state and an on state, and an electrical resistance igniter for igniting fuel at the burner. The control system includes a control interface coupled to the valve; a control board including a boost circuit and a timer circuit, the timer circuit being coupled to the boost circuit and the control interface, the control interface being configured to communicate a control signal to the timer circuit for activation of the boost circuit for a predetermined period of time; a first direct current power supply coupled to the boost circuit and the electrical resistance igniter, where power from the first power supply is provided to the electrical resistance igniter through the boost circuit during the predetermined period of time; and a second direct current power supply coupled to the electrical resistance igniter and the control interface, the second direct current power supply being configured to provide power to the electrical resistance igniter after expiration of the predetermined time period to maintain the igniter at a predetermined temperature above an ignition temperature of the fuel, wherein a voltage from the first direct current power supply is greater than a voltage from the second direct current power supply.

These as other aspects and advantages of the exemplary embodiments will become more apparent from the following detailed description considered in conjunction with the accompanying drawings. It is to be understood, however, that the drawings are designed solely for the purposes of illustration and not as a definition of the limits of the invention, for which reference should be made to the appended claims. Moreover, the drawings are not necessarily to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
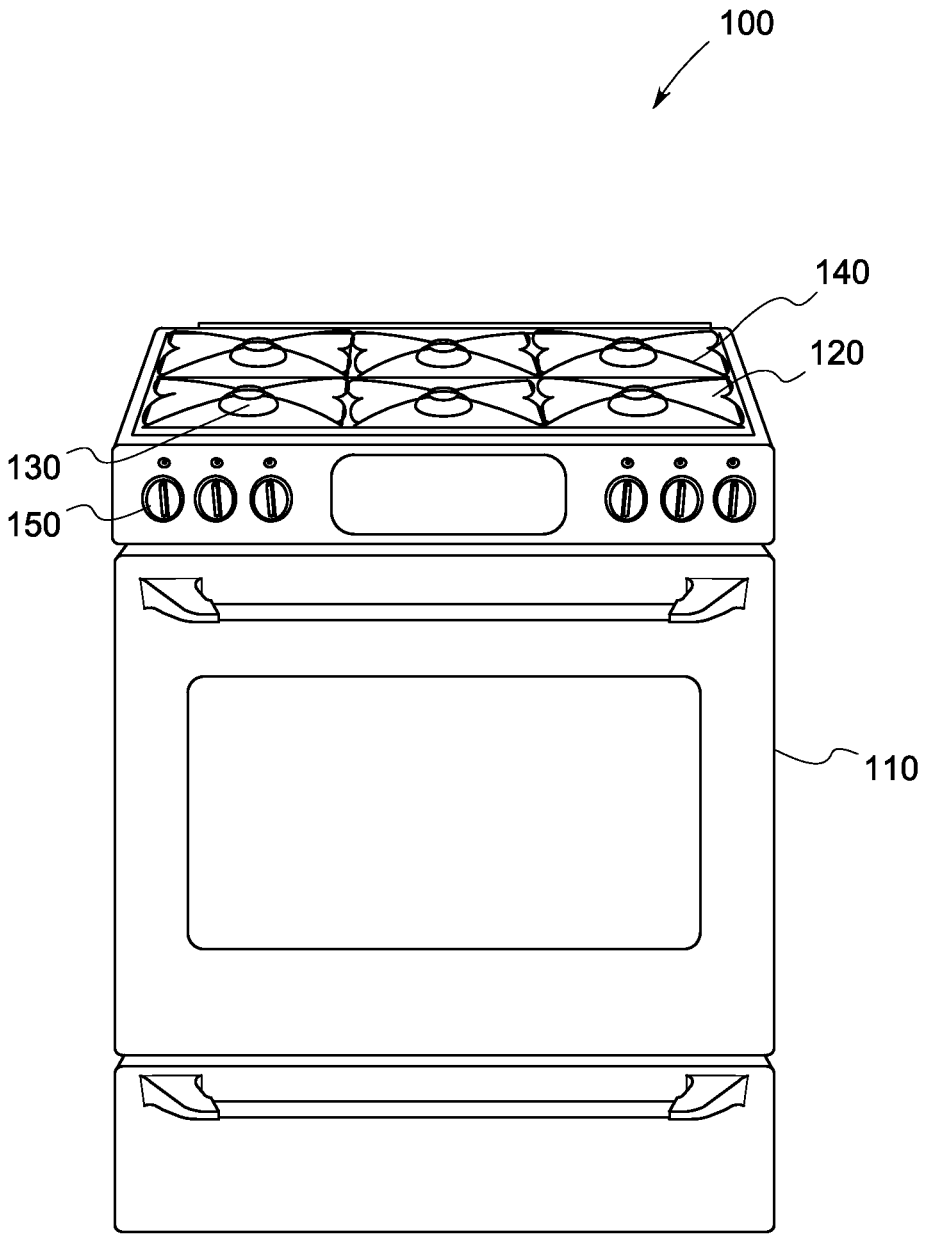
FIG. 1 is a schematic illustration of an exemplary cooking appliance in accordance with an exemplary embodiment.

In one exemplary embodiment, referring to FIG. 1, a cooking appliance 100 is provided. Although the embodiments disclosed will be described with reference to the drawings, it should be understood that the embodiments disclosed can be embodied in many alternate forms. In addition, any suitable size, shape or type of elements or materials could be used. In the embodiments described herein, the cooking appliance 100 is configured as a free standing gas cooking appliance. However, it should be understood that the aspects of the exemplary embodiments may be applied to any suitable appliance having a gas burner(s) and an associated ignition system in a manner substantially similar to that described herein.

Figure 2:
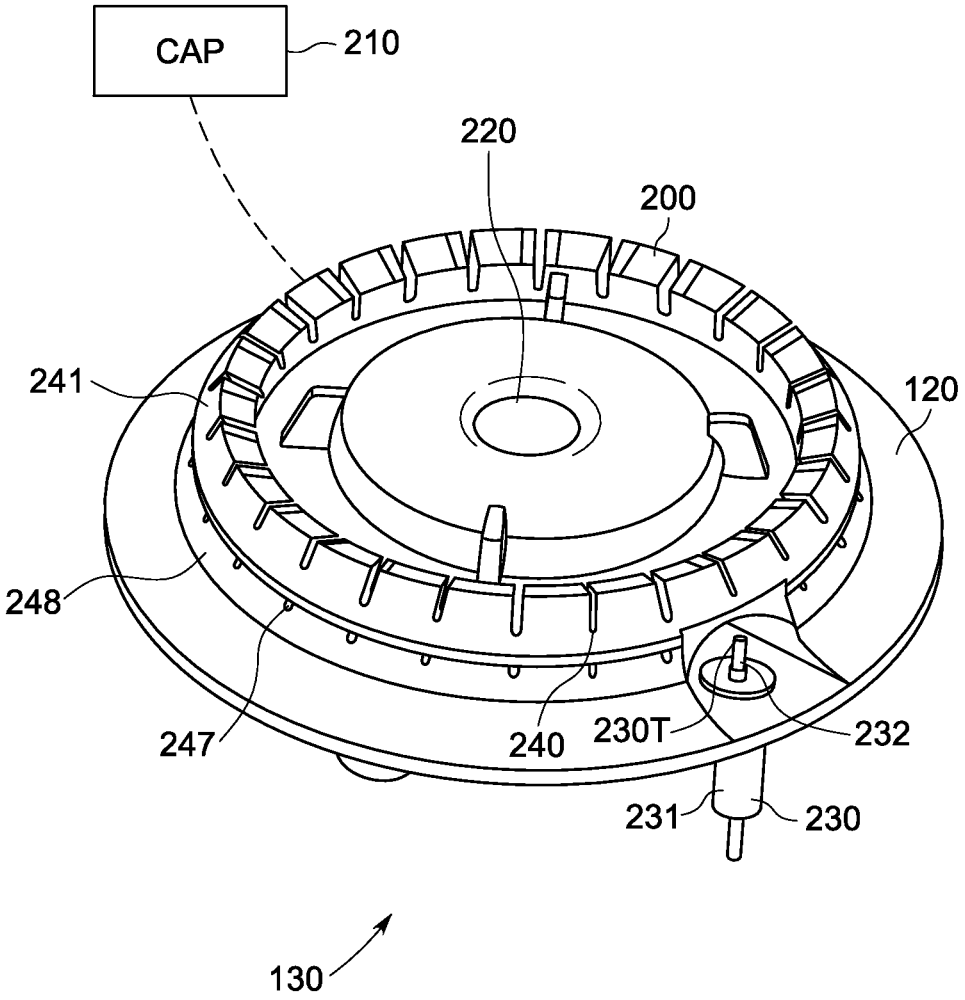
FIGS. 2 and 2A are schematic illustrations of a burner and igniter of the cooking appliance in FIG. 1.
Figure 4:
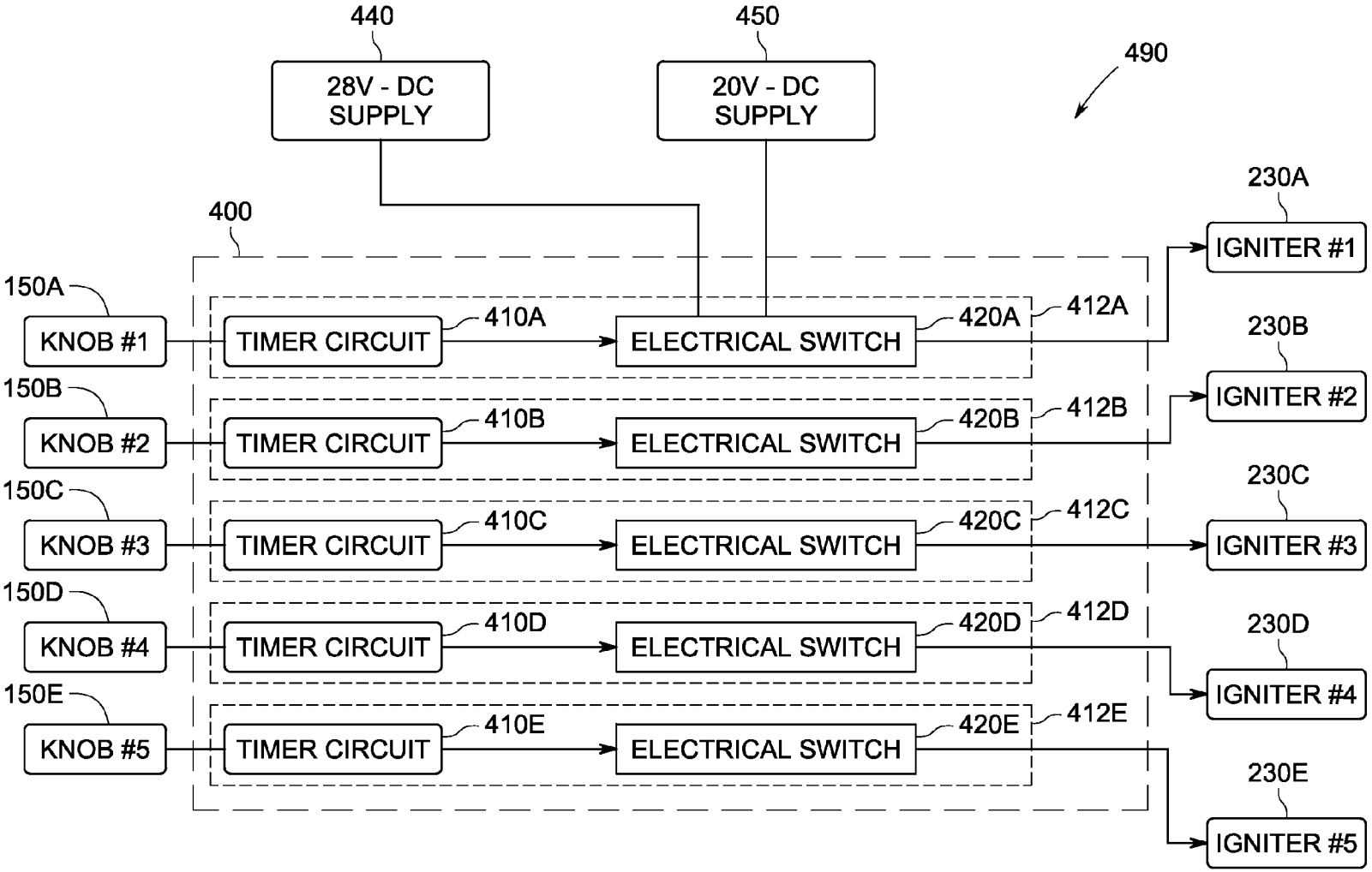
FIG. 4 is another schematic illustration of an ignition control system of the cooking appliance of FIG. 1.

In one aspect, the exemplary embodiments provide a cooking appliance 100 having a frame 110 forming a cooktop 120. The cooktop 120 includes surface heating units in the form of burners 130 and grates 140 for supporting items to be heated over the burners. The cooking appliance 100 also includes suitable user actuable controls such as, for exemplary purposes only, gas control interfaces, such as knobs 150 that are connected to suitable control valves and a manifold for selectively providing fuel to a respective one of the burners 130 to enable the user to control the heat output of the burners. The control interfaces have an off state selected by the user when no energization of the burner is desired and an on state which includes all non-off positions of the interface, which in the case of knobs may be a plurality of specifically designated discrete positions or the continuous rotational positions of the knob other than the designated off position. Referring also to FIGS. 2 and 4, in this example, the cooking appliance 100 includes a hot surface igniter system including electrical resistive igniters 230A-230E, such as, hot surface igniter 230 shown in FIG. 2, a non-microprocessor based controller or control board 400 for a timed application of set voltages, two or more low voltage direct current (DC) power supplies and/or transformers 440, 450 and associated wiring harnesses or electrical couplings to maintain communications between the igniters 230A-230E, the circuit board 400 and the power supplies 440, 450. In one example, the power supplies 440, 450 are common to all of the burners 130, but separate control or hub circuits 412A-412E are provided for each burner for controlling each burner's hot surface igniter 230. In alternate embodiments, each of the separate control circuits 412A-412E may have its own power supply(s). One advantage with the low voltage DC based igniter system approach of the exemplary embodiments is that there is substantially no chance of an explosive failure of the igniter since the current available from such a power supply is limited.

Figure 6:
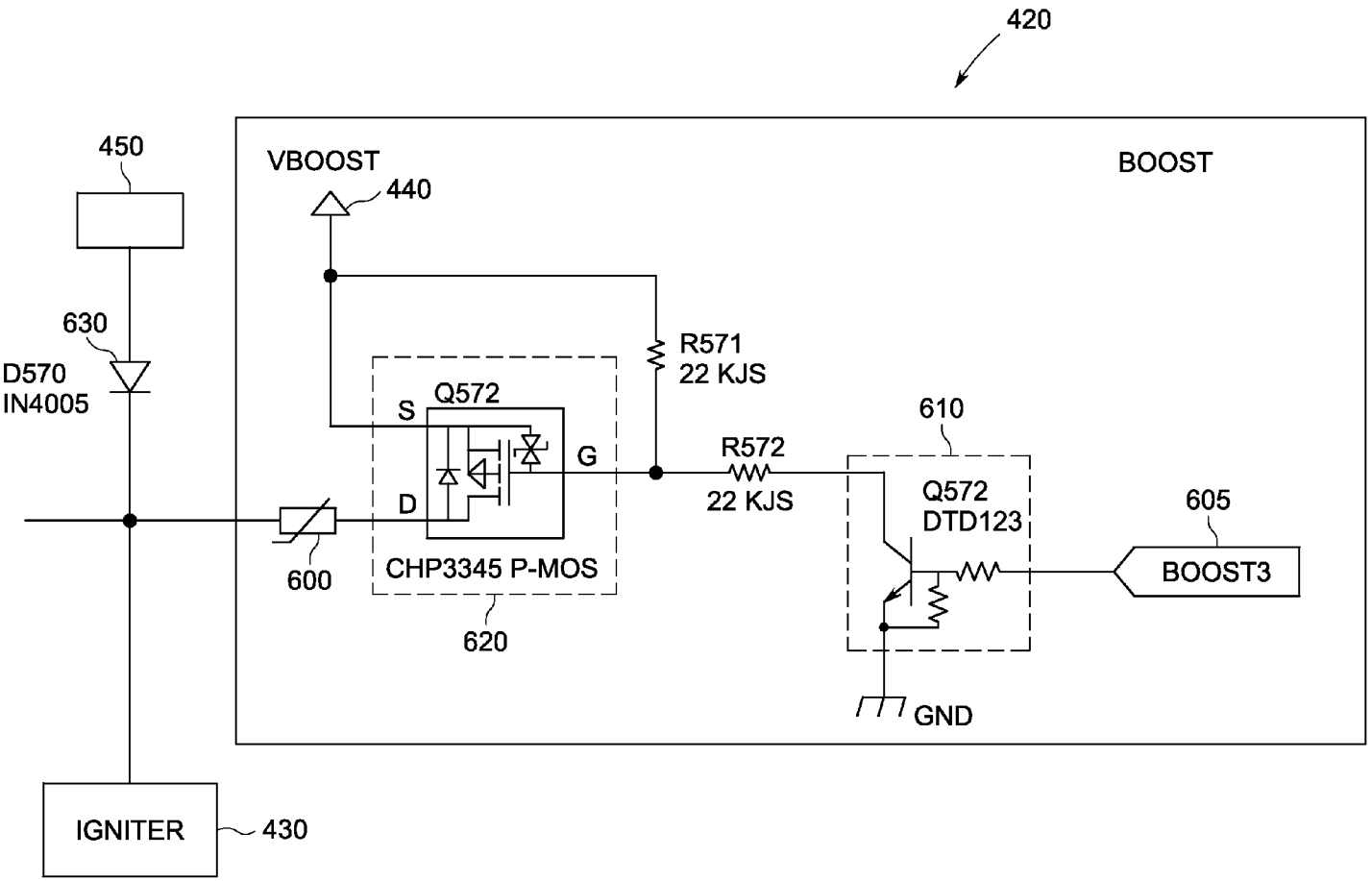
FIG. 6 is a schematic diagram of a portion of the ignition control system of FIG. 4 in accordance with an exemplary embodiment.

The control circuits 412A-412E include boost circuits 420A-420E respectively, one of which is shown in greater detail in FIG. 6. Each boost circuit is configured to limit in-rush current to the respective hot surface igniter 230 and/or provide an initial boost current for a predetermined time to reduce the time required for the igniter to reach the gas ignition temperature. The hot surface igniter 230 remains energized throughout the use cycle, but at a current following expiration of the predetermined time, which is sufficient to maintain the igniter temperature at or above the ignition temperature but which is lower than the boost current to, for example, re-ignite the burner flame in the event the flame goes out.

Figure 2A:
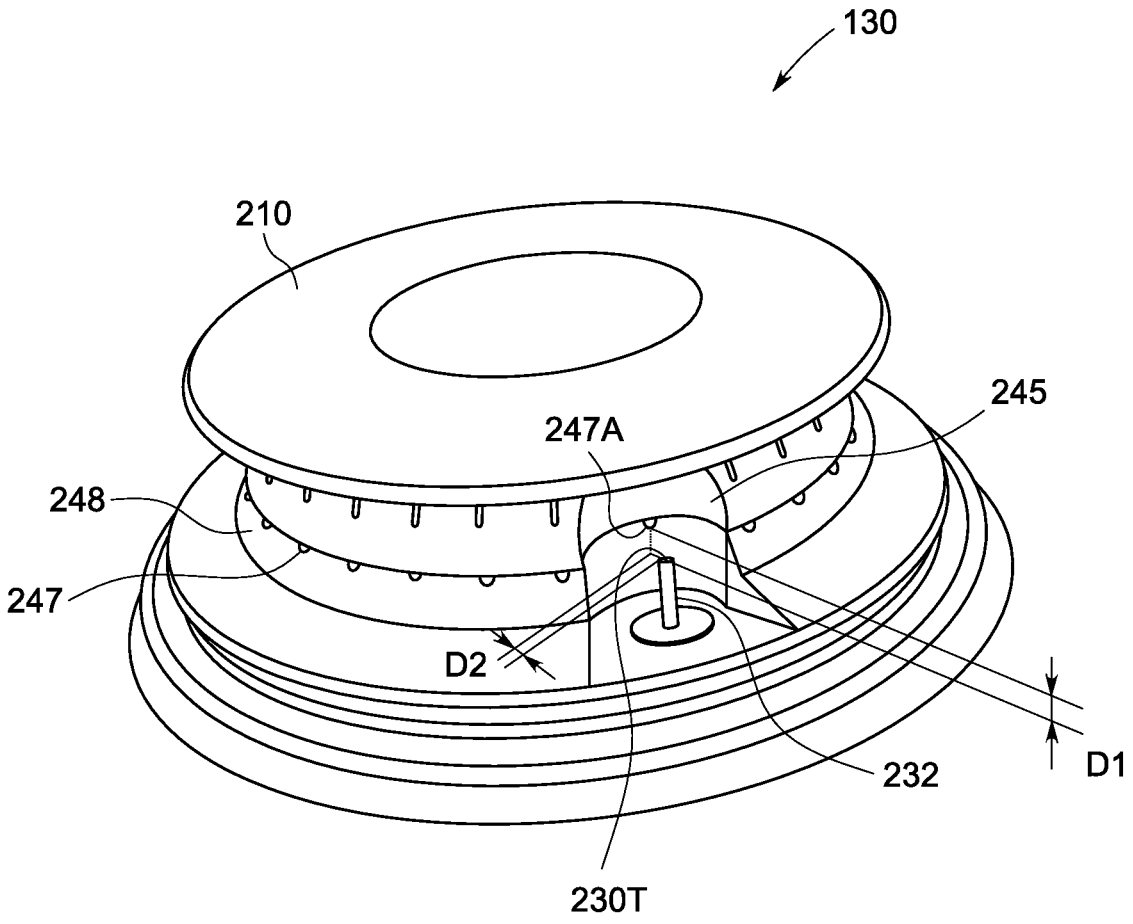

Still referring to FIG. 2 and also to FIG. 2A, each burner 130 includes a gas burner body 200, a burner cap 210 which is placed on the burner body 200 to form a gas chamber, a venturi 220 for introducing gas into the burner body 200 and a plurality of gas ports 240 disposed around a perimeter of the burner 130 for exhausting the gas. In this example the burner body 200 is configured as a dual stack burner having a main burner ring 241 and a simmer ring 248. The main burner ring 241 includes main gas ports 240 and the simmer burner ring includes simmer ports 247. The burner body 200 includes a recessed portion that forms a stability chamber 245. Each hot surface igniter 230 is disposed adjacent a respective burner 130 at least partially within the stability chamber 245 for igniting gas at the burner gas ports 240 and/or the simmer ports 247. For exemplary purposes only the hot surface igniters 230 may reach ignition temperatures of about 1200° C. to about 1325° C. for natural gas and LP gas within about 2 seconds to about 4 seconds of the control interface, knob 150, being turned to an "on" position.

In one example, the hot surface igniter 230 of FIG. 2 includes a generally cylindrical silicon nitride igniter body 232 doped with a conductive high temperature alloy molybdenum disilicide ($MoSi_2$). By using exact quality controls, a relatively tight zone of operation may be maintained where the igniter temperature quickly reaches the fuel ignition temperature and maintains that level without exceeding temperatures that significantly reduce igniter life. In alternate embodiments the hot surface igniter 230 may have any suitable shape and cross-section. A ceramic insulator 231 supports and insulates the igniter body 232 from direct contact with the respective burner 130 and the cooktop 120. For exemplary purposes only, each hot surface igniter 230 may be about a 2.7 ohm+/−about 0.3 ohm igniter with a mass of about 1.8 g and a specific heat capacity of about 0.2 W/C. Generally, the hot surface igniter 230 will have suitable characteristics for igniting a flame at the burner gas ports 240 and/or the simmer ports 247 in accordance with the exemplary embodiments. In another example, the hot surface igniter 230 has a resistance in the range of about 2.4 ohms to about 3.0 ohms in the cold state and/or have a body of silicon carbide or other similarly conductive ceramic material. In this example, the hot surface igniter 230 when operated at peak voltage on the order of 31VDC, will have a nominal time to reach ignition temperature, that is a temperature sufficient to ignite the flame at the burner gas ports 240 and/or the simmer ports 247, on the order of 2.5 seconds.

In a spark igniter system, a very large voltage potential is maintained and discharged rapidly until the control knob is rotated away from or off the ignition setting. In the exemplary embodiments, the hot surface igniter 230 remains energized during the use cycle of the burner (e.g. as long as the respective control knob is in an "on" position). Any change in voltage of the hot surface igniter 230 can be detected and used to alert the cooking appliance operator of, for example, a loss of igniter function or a change in resistance of the igniter.

In one example, the hot surface igniter 230 may also function as a low wattage heater that may be used in lieu of a gas flame during low heat cooking modes such as, for example, a simmer. In one example, the hot surface igniter 230 may function as a heater having about a 25 watt power rating. In alternate examples, the hot surface igniter 230 may be configured to have any suitable power ratings for low heat cooking modes. Where the hot surface igniter 230 is used as a heater during low heat cooking modes, the gas flow to the respective burner 130 is shut off. For example, the control knob 150 may be configured with a low or simmer setting near, for example, the end of the control knob's rotation, that turns off the gas valve but maintains the respective hot surface igniter 230 in an energized state. It should be understood that other suitable control interfaces (other than mechanical knobs and valves) may be used to control operation of the gas valves such as, for exemplary purposes only, sliders, buttons, solenoids and electronic control panels.

The hot surface igniter 230 may be placed any suitable distance relative to the stability chamber 245 for igniting the gas exhausted from the gas port 240 and/or simmer port 247. In one exemplary embodiment a tip 230T of the hot surface igniter 230 may be disposed, for example, substantially horizontally from-a simmer port 247A disposed within the stability chamber 245 of the burner 130 by a distance D2 of about 0.125 inches to about 0.75 inches. In one example, the distance D2 may be about 0.60 inches. In another example, the distance D2 may be about 0.25 inches. The tip 230T of the hot surface igniter 230 may also be vertically disposed relative to the gas port 247A in the stability chamber 245 within a distance D1 of about 0.0625 inches. In another example, the tip 230T of the hot surface igniter 230 may also be vertically disposed relative to the gas port 247A within a distance D1 of about 0.030 inches. In still other examples the distances D1 and D2 may be any suitable distances for providing sufficient heat adjacent the burner for igniting the burner flame in the manner described herein.

Figure 3:
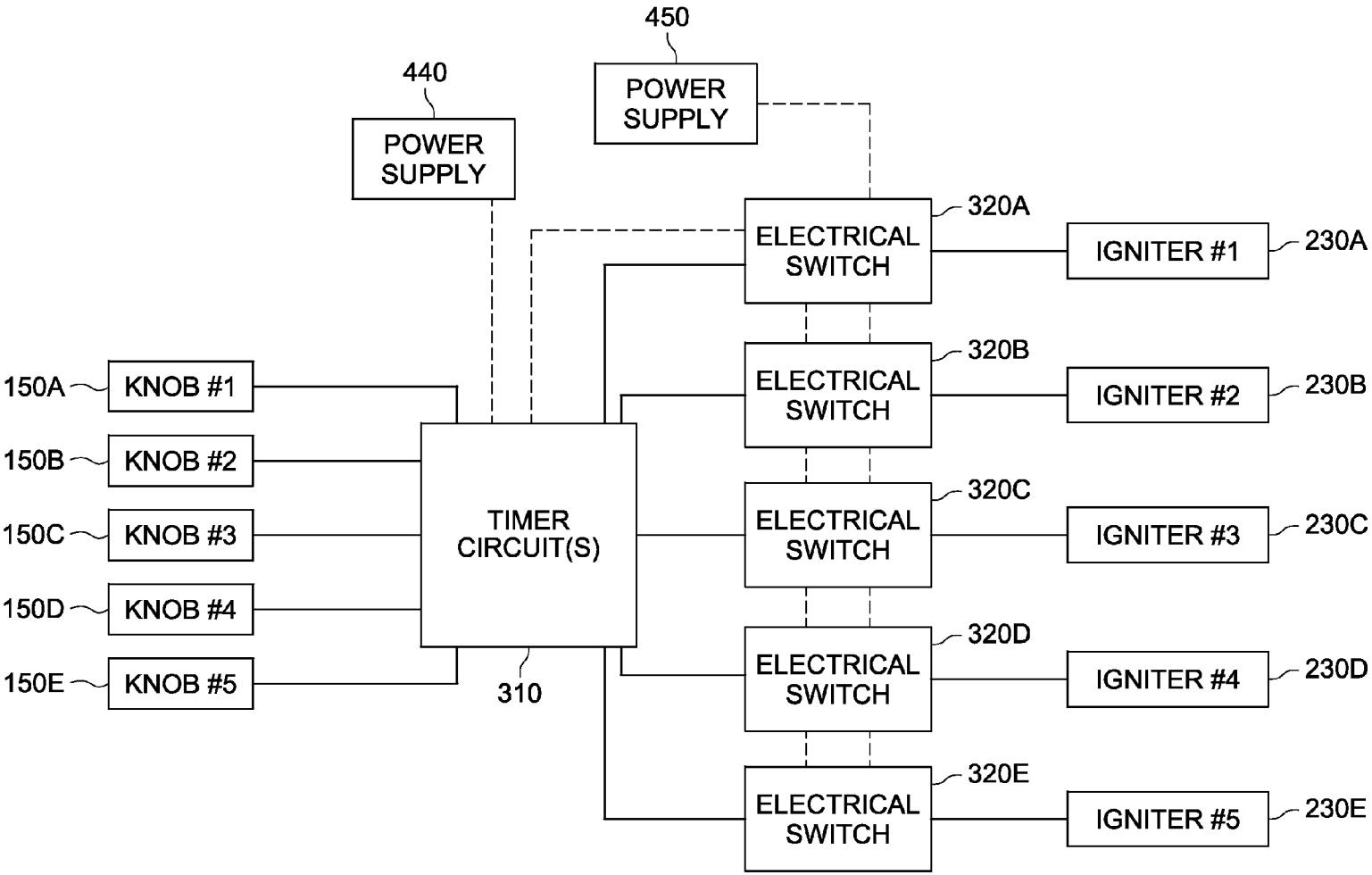
FIG. 3 is a schematic illustration of an ignition control system of the cooking appliance of FIG. 1.

Referring also to FIG. 4, an exemplary schematic of an ignition control system 490 for the hot surface igniter 230 is shown. The control system 490 generally includes several control or hub circuits 412A-412E that are used to boost the voltage being applied to the hot surface igniters 230A-230E for a specified period of time for lighting a respective burner 130 (FIG. 1). The control circuits 412A-412E may also provide in-rush current protection for each of the respective hot surface igniters 230A-230E. In this example, there are five interface controls in the form of control knobs 150A-150E that are electrically coupled to the control board 400. The control board 400 includes five separate control circuits 412A-412E, corresponding to respective ones of the control knobs 150A-150E, for individually controlling a respective one of the hot surface igniters 230A-230E (e.g., each of the hot surface igniters 230A-230E is operable independent of other hot surface igniters). Each of the separate control circuits 412A-412E includes a respective timer circuit 410A-410E and a respective switching circuit 420A-420E. In alternate embodiments, the control system 490 may include any suitable number of control knobs and corresponding control circuits for controlling a respective hot surface igniter. When a control knob, such as control knob 150A is turned to an "on" position, the timer circuit 410A is activated to turn on electrical switch 420A so that a first voltage (e.g., a boost voltage) is applied to the hot surface igniter 230A for a predetermined period of time. When the predetermined period of time expires the electrical switch 420A returns to its normally closed position so that a second voltage can be provided to the hot surface igniter 230A as long as the respective burner is active (e.g., the control knob is at an "on" position). In one exemplary embodiment, each of the electrical switches 420A-420E comprises the boost circuit shown in greater detail in FIG. 6 for applying the first and second voltage to the respective hot surface igniter 230A-230E in a manner hereinafter described. In other examples, the electrical switches 420A-420E can switch between different taps of, for example, the power supply or power supply transformer for providing the first and second voltages to the respective hot surface igniter 230A-230E. In still other examples, the electrical switches 420A-420E can switch between, for example, different Zener diodes to determine the voltage rail potential for applying the first and second voltages to the respective hot surface igniter 230A-230E. In yet other examples the electrical switches can switch between the first and second power supplies 440, 450 in any suitable manner. For exemplary purposes only, the timer circuits 410A-410E and electrical switches 420A-420E are shown in FIG. 4 as being part of control board 400. However, referring to FIG. 3, in other examples there may be two types of boards, a main board 310 including, for example, at least one power supply and/or timer circuit(s), and daughter boards 320A-320E each including an electrical switch. In this example, the power supply 440, while shown separate from the main board 310, may be integral with the main board 310. The main board 310 may include one or more timer circuits substantially similar to timer circuits 410A-410E where each timer circuit of the main board 310 is connected to a respective one of the daughter boards 320A-320C. In other examples, the main board 310 may include a timer having a switch for selectively coupling the timer to any one of the daughter boards 320A-320E. The daughter boards 320A-320E may each include a respective electrical switch where each of the daughter board electrical switches is substantially similar to electrical switches 420A-420E. The main board and daughter board configuration may allow for easy expansion of the control system 490 to accommodate any suitable number of burners. For example, the main board 310 may be configured to allow for connection of any suitable number of daughter boards so that burners may be added, removed or replaced without removing the main board 310 and vice versa. The main board and daughter board may be connected to each other in any suitable manner such as through suitable electrical connectors.

The first and second low voltage direct current (DC) power supplies 440, 450 shown in FIG. 4 are provided for energizing the hot surface igniters 230A-230E. In this example, both of the first and second power supplies 440, 450 are common to the separate hub circuits 412A-412E. In alternate embodiments, each hub circuit 412A-412E can have its own separate power supply. The first power supply 440 generally has a higher power rating than the second power supply 450 such that the first power supply 440 provides the first voltage (e.g. boost voltage) to the hot surface igniter 230 and the second power supply 450 provides the second voltage to the hot surface igniter 230. For example, in one embodiment, the first power supply 440 has a 28 V DC power rating while the second power supply 450 has a 20 V DC power rating. In other examples, the first and second power supplies 440, 450 may have any suitable power ratings for providing the first and second voltages where the second voltage is lower than the first voltage. In one example, the first voltage is less than 31 V DC.

Figure 5:
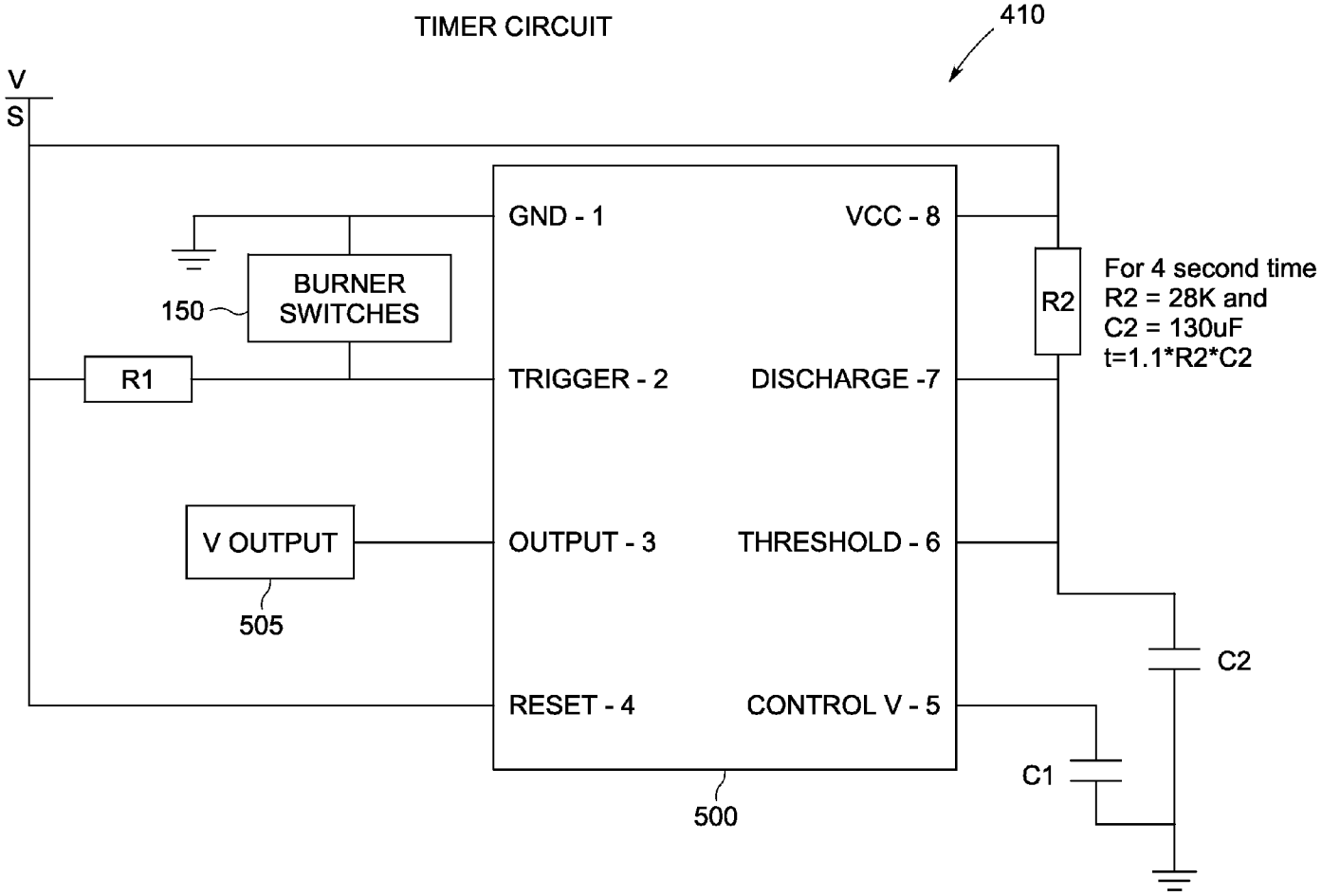
FIG. 5 is a schematic diagram of a portion of the ignition control system of FIG. 4 in accordance with an exemplary embodiment.

Referring to FIG. 5, an exemplary timer circuit 410 is illustrated. The timer circuit 410 of FIG. 5 is illustrative of timer circuits 410A-410E. Timer circuit 410 includes a timer 500. The timer 500 may be any suitable timer such as, for example, a 555 integrated circuit type timer. A control, such as one of the control knobs 150A-150E, is connected to the timer 500 to provide a trigger for starting the timer 500. The timer 500 is configured to generate a time pulse of predetermined duration, referred to herein as a time cycle or period. The time cycle is a time period sufficient for allowing the hot surface igniter 230 to reach a temperature above the ignition temperature of the gas exhausted from the gas ports 240 and/or the simmer ports 247 shown in FIG. 2. For exemplary purposes only the predetermined time period corresponds to the first few seconds (e.g., about 2 second to about 4 seconds) of burner activation. When the timer 500 receives the trigger from the control knob 150, the timer 500 generates a corresponding output voltage (time pulse) signal 505. The output signal 505 from the timer 500 is supplied to the boost circuit 420 shown in FIG. 6.

In the example of FIG. 6, the boost circuit 420 is configured to allow switching between the first and second power supplies 440, 450. In this example, the boost circuit 420 functions as a respective one of the electrical switches 420A-420E depending on which control knob 150A-150B is actuated. The boost circuit 420 includes a first switching device 610 and a second switching device 620. The first switching device 610 may be any suitable switching device such as, for example, a digital transistor, while the second switching device 620 may be any suitable switching device such as, for example, a P-channel MOSFET switch. The output signal 505 from the timer or time circuit 500 of FIG. 5 is coupled to input 605 of the first switching device 610 of the boost circuit 420.

When a burner switch 150 is turned on, the first switching device 610 receives the output signal 605 of the timer 500. The first switching device 610 causes the second switching device 620 to turn on. When the second switching device 620 is turned on, the power from the first power supply 440 is provided to the hot surface igniter 230. Suitable protective devices 630, such as diodes, may be provided between the boost circuit 420 and the second power supply 450 to prevent current from flowing from the first power supply 440 to the second power supply 450. At the end of the time cycle generated by the timer 500, the state of output signal 505 from the timer 500 that is supplied to the first switching device 610 changes and causes the second switching device 620 to turn off. This interrupts the flow of power from the first power supply 440 to the hot surface igniter 230.

For example, in one embodiment, when a control knob 150 is switched on, or closes, the output 505 of timer 500 goes high. This causes first switching device 610 to conduct, which in turn biases the second switching device 620 to conduct. The output of the boost circuit 420 is coupled to the hot surface igniter 230. For either of the first power supply 440 or second power supply 450 to supply power to the hot surface igniter 430, the control knob 150 needs to be in the closed position. When the control knob 150 is closed, the timer 500 sees the falling edge of the corresponding voltage signal and the output from the boost circuit 420, the boost circuit voltage from first power supply 440, is applied to the hot surface igniter 230. After the set timing cycle of the timer 500 expires, the output 505 from the timer circuit 500 goes low. The second power supply 450, or low voltage supply, continues to power the hot surface igniter 230 as long as the control knob 150 remains in the on, or closed position. In one embodiment, the control knob 150 comprises a double pole, single throw (DPST) switch.

The boost circuit 420 (or the control board 490 in FIG. 4 in general) may include a self-regulating electronic feature that mitigates the in-rush of current at the start of energizing the igniter 230. The in-rush current protection for the hot surface igniter 230 may be provided in any suitable manner. In the example of FIG. 6, the in-rush protective device comprises thermistor 600, provided in series between the first power supply 440 and the hot surface igniter 230. In other examples, the in-rush current protective device may be disposed at any suitable location within the control system 490 (FIG. 4). The in-rush current protection device 600 may provide benefits in sizing DC transformers/power supplies that are capable of supplying elevated boost voltages (e.g., the first voltage) in the event all of the burners 130 of the cooking appliance 100 (FIG. 1) are activated simultaneously. The in-rush current protection may allow for selection of smaller transformers/power supplies when compared to transformers/power supplies that would be needed absent the in-rush current protection. It is noted that, in one example, except for during the predetermined time period provided by timer 410 (during which the hot surface igniter 430 operates at the first voltage), the hot surface igniter 230 operates at the second voltage for increasing the life of the igniters.

The cooking appliance controls, such as control knob 150 in FIG. 1, may be connected to the second power supply 450 in any suitable manner such that when the control knob 150 is turned to an "on" position the second power supply 450 provides power to the hot surface igniter 230. However, during the predetermined time cycle provided by the timer 500, application of power from the first power supply 440 prevents power from the second power supply 450 from reaching the hot surface igniter 230. When transmission of power from the first power supply 440 to the hot surface igniter 230 stops, after the predetermined time period, power is provided from the second power supply 450 to the hot surface igniter 230 and that the hot surface igniter 230 remains energized as long as the respective burner is active, and the control knob 150 is in the "on" position. The second power supply 450 provides sufficient power to the hot surface igniter 230 so that the hot surface igniter 230 remains at or above the ignition temperature of the gas flowing from the respective burner 130 as long as the control knob 150 is in an "on" position. In one example, the hot surface igniter 230 is maintained between about 100° C. and about 120° C. In other examples, any suitable igniter temperature may be maintained where the igniter temperature is above an ignition temperature of the fuel.

The exemplary embodiments described herein provide an ignition control system for a gas burner that uses simple electronic principles and does not utilize a computer or software to evaluate operation of the system. The control board 490 described herein modulates power individually to each of the hot surface igniters 230 and mitigates in-rush current. The control system described herein isolates igniter failures and improves the overall life of the igniter by distributing usage time, as each igniter is operated independently.

Thus, while there have been shown and described and pointed out fundamental novel features of the invention as applied to the exemplary embodiments thereof, it will be understood that various omission and substitutions and changes in the form and details of devices illustrated, and in their operation, may be made by those skilled in the art without departing from the spirit of the invention. For example, it is expressly intended that all combinations of those elements and/or method steps, which perform substantially the same way to achieve the same results, are with the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas powered appliance comprising an ignition control system, a gas burner, a valve for controlling a flow of fuel to the gas burner, and an electrical resistance igniter for igniting fuel at the gas burner, wherein the ignition control system comprises:

a user actuable control interface having an off state and an on state, the control interface coupled to the valve and operative to control the valve and provide a control signal indicative of the state of the control interface;

a controller including:

a timer circuit responsive to the control signal from the control interface; and a boost circuit coupled to the timer circuit, wherein the timer circuit is configured to activate the boost circuit for a predetermined period of time;

a first direct current power supply selectively coupled by the boost circuit to the electrical resistance igniter, where power from the first direct current power supply is provided to the electrical resistance igniter through the boost circuit when the boost circuit is activated; and a second direct current power supply coupled to the electrical resistance igniter and the control interface, the second direct current power supply being configured to provide power to the electrical resistance igniter after expiration of the predetermined period of time to maintain the electrical resistance igniter at a predetermined temperature above an ignition temperature of the fuel, wherein a voltage from the first direct current power supply is greater than a voltage from the second direct current power supply, wherein the control interface comprises a gas control knob, a first position of the gas control knob activating the first direct current power supply to energize the boost circuit and a second position of the gas control knob modulating the flow of fuel to the gas burner with the second direct current power supply in an activated state.

2. The gas powered appliance of claim 1, wherein the electrical resistance igniter remains at or above the ignition temperature of the fuel as long as the control interface is in the on state.

3. The gas powered appliance of claim 1, wherein the voltage from the first direct current power supply is about 31 V DC or less.

4. The gas powered appliance of claim 1, wherein the appliance further comprises a plurality of gas burners and a corresponding plurality of electrical resistance igniters, each igniter being independently operable.

5. The gas powered appliance of claim 1, wherein the appliance is a cooking appliance and the gas burner is a surface unit for heating an item supported over the gas burner, and wherein the electrical resistance igniter is configured to operate as a secondary heater for heating the item supported over the gas burner for a low heat setting for which fuel is not supplied to the gas burner.

6. The gas powered appliance of claim 1, wherein the controller includes a current in-rush protection device configured to mitigate an in-rush of current to the electrical resistance igniter.

7. The gas powered appliance of claim 6, wherein the in-rush protection device comprises a thermistor.

8. The gas powered appliance of claim 1, wherein the controller comprises a main board and at least one daughter board, the main board including the timer circuit and each of the daughter boards including a boost circuit.

9. The gas powered appliance of claim 1, wherein the first direct current power supply and the second direct current power supply are common to the electrical resistance igniter.

10. A method for controlling energizing of a gas burner with an electrical resistance igniter in a control system for a gas powered appliance, the method comprising:

receiving a signal in a timer circuit from a control interface of the gas powered appliance when the control interface is in an on position;

providing power from a first direct current power supply to the electrical resistance igniter through activation of a boost circuit, wherein the timer circuit activates the boost circuit for a predetermined period of time; and after expiration of the predetermined period of time, deactivating the boost circuit and switching the power provided to the electrical resistance igniter from the first direct current power supply to a second direct current power supply to maintain the electrical resistance igniter at a predetermined temperature above an ignition temperature of the fuel, wherein a voltage provided by the second direct current power supply is less than a voltage supplied by the first direct current power supply, wherein the on position of the control interface activates the first direct current power supply to energize the boost circuit and a second position of the control interface modulates a flow of fuel to the gas burner with the second direct current power supply in an activated state.

11. The method of claim 10, further comprising maintaining the electrical resistance igniter at or above the ignition temperature of the fuel as long as the control interface is at the on position.

12. The method of claim 10, wherein the appliance includes multiple gas burners, each with an electrical resistance igniter, and an electrical resistance igniter of one gas burner operates independently of another gas burner.

13. The method of claim 10, further comprising operating the electrical resistance igniter as a secondary heater for the gas burner where fuel is not supplied to the gas burner during operation of the secondary heater.

14. The method of claim 10, further comprising mitigating an in-rush of current to the electrical resistance igniter with a thermistor disposed between the first direct current power supply and the second direct current power supply and the electrical resistance igniter.

15. The method of claim 10, wherein the first direct current power supply and the second direct current power supply are common to the electrical resistance igniter.

16. A gas cooking appliance comprising an ignition control system, a burner, a user actuatable valve for controlling a flow of fuel to the burner, the user actuatable valve being movable between an off state and an on state and an electrical resistance igniter for igniting fuel at the burner, wherein the ignition control system comprises:

a control interface coupled to the valve;

a control board including a boost circuit and a timer circuit, the timer circuit being coupled to the boost circuit and the control interface, the control interface being configured to communicate a control signal to the timer circuit for activation of the boost circuit for a predetermined period of time;

a first direct current power supply coupled to the boost circuit and the electrical resistance igniter, where power from the first direct current power supply is provided to the electrical resistance igniter through the boost circuit during the predetermined period of time; and a second direct current power supply coupled to the electrical resistance igniter and the control interface, the second direct current power supply being configured to provide power to the electrical resistance igniter after expiration of the predetermined period of time to maintain the igniter at a predetermined temperature above an ignition temperature of the fuel, wherein a voltage from the first direct current power supply is greater than a voltage from the second direct current power supply, wherein the control interface comprises a gas control knob, a first position of the gas control knob activating the first direct current power supply to energize the boost circuit and a second position of the gas control knob modulating the flow of fuel to the burner with the second direct current power supply in an activated state.

17. The gas cooking appliance of claim 16, wherein the electrical resistance igniter remains at or above the ignition temperature of the fuel as long as the control interface is at an on position.

18. The gas cooking appliance of claim 16, wherein the gas cooking appliance includes multiple burners, each with an electrical resistance igniter, and an electrical resistance igniter of one burner operates independently of another burner.

19. The gas cooking appliance of claim 16, wherein the electrical resistance igniter is configured to operate as a secondary heater for the burner where fuel is not supplied to the burner during operation of the secondary heater.

20. The gas cooking appliance of claim 16, wherein the control board includes a thermister disposed to mitigate an in-rush of current to the electrical resistance igniter.

* * * * *